US006524117B1

(12) United States Patent
Murakami et al.

(10) Patent No.: US 6,524,117 B1
(45) Date of Patent: Feb. 25, 2003

(54) ELECTRIC CONNECTING APPARATUS FOR ELECTRICALLY CONNECTING TWO ELECTRIC COMPONENTS

(75) Inventors: Masakazu Murakami, Hikone (JP); Ken Abe, Yokohama (JP); Shin Hasegawa, Hikone (JP)

(73) Assignee: The Furukawa Electric Co., Ltd. (JP)

( * ) Notice: Subject to any disclaimer, the term of this patent is extended or adjusted under 35 U.S.C. 154(b) by 0 days.

(21) Appl. No.: 09/675,273

(22) Filed: Sep. 29, 2000

(30) Foreign Application Priority Data

Sep. 30, 1999 (JP) ..... 11-279176

(51) Int. Cl.[7] ..... H01R 9/09
(52) U.S. Cl. ..... 439/74; 439/924.1
(58) Field of Search ..... 439/76.2, 65, 66, 439/69, 80, 74, 924.1

(56) References Cited

U.S. PATENT DOCUMENTS 3,267,334 A * 8/1966 Wulc ..... 317/101
3,432,795 A * 3/1969 Jayne ..... 439/60
3,659,243 A * 4/1972 Gluntz ..... 439/525
3,711,819 A * 1/1973 Matthews ..... 439/682
3,864,000 A * 2/1975 Coller et al. ..... 439/246
4,082,394 A * 4/1978 Gedney et al. ..... 339/17 M
4,655,518 A * 4/1987 Johnson et al. ..... 439/62
4,867,690 A * 9/1989 Thumma ..... 439/79
5,035,632 A * 7/1991 Rudoy et al. ..... 439/108
5,384,492 A * 1/1995 Carlson et al. ..... 307/147
5,548,891 A * 8/1996 Sakemi et al. ..... 29/842
5,709,574 A * 1/1998 Bianca et al. ..... 439/858
5,718,598 A * 2/1998 Saka et al. ..... 439/404
5,782,651 A * 7/1998 Konoya ..... 439/405
6,000,952 A * 12/1999 Gladd et al. ..... 439/76.2
6,006,298 A * 12/1999 Satoh ..... 710/103
6,007,351 A * 12/1999 Gabrisko, Jr. et al. ..... 439/76.2
6,014,533 A * 1/2000 Kawana ..... 399/90
6,126,457 A * 10/2000 Smith et al. ..... 439/76.2
6,129,564 A * 10/2000 Kawamae et al. ..... 439/101
6,247,937 B1 * 6/2001 Miwa et al. ..... 439/59

FOREIGN PATENT DOCUMENTS

JP 404133280 A * 5/1992 ..... 439/924.1
JP 09238419 9/1997

* cited by examiner

*Primary Examiner*—Tulsidas Patel
*Assistant Examiner*—Thanh-Tam Le
(74) *Attorney, Agent, or Firm*—Knobbe, Martens, Olson & Bear, LLP

(57) ABSTRACT

An electric connecting apparatus provides electrical connection of two electric components by fitting a plurality of male terminals into mating female terminals. If the male terminals have different lengths, for example, the male terminals are fitted into the female terminals in an order of a longer one to a shorter one. In this case, the inserting force that is needed for the entire array of male terminals at the time the two electric components are connected together does not reach a peak at one time, but the inserting forces for the individual male terminals reach peaks one after another. This can permit the two electric components to be connected together with a less labor.

14 Claims, 6 Drawing Sheets

10
12
6
t
8
2
C3
C4

ELECTRIC CONNECTING APPARATUS FOR ELECTRICALLY CONNECTING TWO ELECTRIC COMPONENTS

BACKGROUND OF THE INVENTION

1. Field of the Invention

The present invention relates to an electric connecting apparatus for electrically connecting two electric components together by fitting an array of male terminals into an array of female terminals.

2. Description of the Related Art

This type of electric connecting apparatus is widely used for connection of, for example, electric components by means of an electric connection box of an automobile, connection of connectors of wiring harnesses. More specifically, an electric connection box of an automobile comprises an upper case and a lower case which are assembled together with electric components, such as bus bars and a wiring plate, intervened between both cases. Attached to the upper case are various kinds of electric components, such as a relay, fuse, connector, capacitor, diode, ECU (Electronic Control Unit) board, and PTC (Positive Temperature Coefficient). Of such electric components, for example, bus bar tabs and board terminals or bus bar tabs and connector terminals are in a male-female relationship. This permits those electric components to easily have an electric connection by a relative fitting action alone.

One specific example is disclosed in, for example, Japanese Unexamined Patent Publication (KOKAI) No. Hei 9-238419/1997. The main body of this prior art electric connection box has a bus-bar wiring plate from which a plurality of male terminals extend. An electronic board which is to be attached to the main body of the electric connection box is provided with female terminals at positions corresponding to the positions of the mating male terminals. As the electronic board is pressed into the main body, the female terminals are fitted over the mating male terminals.

This conventional electric connection box however requires that all the male terminals should be fitted into the respective female terminals at the same time when the electronic board is pressed into the main body of the electric connection box. In this case, the larger the number of terminals to be fitted together becomes, the greater the total inserting force required becomes according to the total number of the terminals, slight though the inserting force needed for each pair of a male terminal and a female terminal is.

Under such a situation, it demands a worker of a significant labor to manually attach an electronic board to the main body of an electric connection box. If the worker attempts to press the electronic board into the main body forcibly, some of the terminals may be damaged or broken. In this respect, special equipment for pressing an electronic board into the main body of an electric connection box in the step of attaching the electronic board in manufacturing the electric connection box. The use of such special equipment leads to an increased manufacturing cost of the electric connection box and is not suitable for mass production of electric connection boxes.

SUMMARY OF THE INVENTION

Accordingly, it is an object of the present invention to provide an electric connecting apparatus which can significantly reduce the required inserting force even when multiple male terminals and female terminals are needed to connect electric components together.

To achieve the above object, according to this invention, there is provided an electric connecting apparatus for electrically connecting two electric components together, which comprises an array of male terminals provided on one of the electric components; an array of female terminals provided on the other electric component; and time-lag application means for applying a time lag to initial contacts between the male terminals and the female terminals when the two electric components are connected together. The male terminals can respectively be fitted into the female terminals when the two electric components are connected together.

According to the electric connecting apparatus of this invention, the timing at which the inserting force that is needed for each of the array of male terminals reaches a peak in the process of connecting two electric components is not the same for the inserting force for the other male terminals, so that the required inserting forces for all the male terminals do not reach peaks at one time. This phenomenon is based on the following characteristic of a change in inserting force with respect to the amount of fitting of each male terminal into its mating female terminal after an initial contact therebetween. In general, at the time one male terminal is fitted into its mating female terminal, the required inserting force gradually increases from the point of the initial contact, reaches a peak when the amount of fitting of the male terminal increases to a certain level, and decreases thereafter as the male terminal is fitted deeper into the female terminal. It is often considered that the required inserting force of a male terminal into its mating female terminal reaches a peak when the portion of the female terminal where the male terminal contacts is widened most. Even when connecting two electric components requires a work of fitting multiple male terminals into the mating female terminals, therefore, an excessive labor is not needed for that fitting work, thus significantly reducing a burden on a worker.

When the time-lag application means includes a plurality of male terminals whose distal ends are at different positions from one another as seen in a fitting direction to the female terminals, those male terminals have initial contacts in an order from one whose distal end position is closer to the mating female terminal to one whose distal end position is farther to the mating female terminal at the time the two electric components are connected together. In this case, the plurality of male terminals may all have different lengths from one another, or may be classified into a type having relatively long lengths and a type having relatively short lengths. In either case, it is preferable that the time-lag application means should further include a plurality of female terminals having contacts to the male terminals at same positions as seen in the fitting direction of the male terminals.

The time-lag application means may include a spacer which gives an offset to proximal ends of the female terminals in the fitting direction of the male terminals. In this case, the amount of offset varies in accordance with the thickness of the spacer and the female terminals have initial contacts in an order from one which has a smaller amount of offset to one which has a larger amount of offset at the time the two electric components are connected together. It is preferable that the time-lag application means should further include a plurality of male terminals whose distal ends are all at the same position as seen in the fitting direction of the male terminals to the female terminals and that those male terminals should all have the same length.

Alternatively, the time-lag application means may include a plurality of female terminals having contacts to the male terminals at different positions from one another as seen in the fitting direction of the male terminals. In this case, those female terminals have initial contacts in an order from one whose contact position is closer to the distal end of the mating male terminal as seen in the fitting direction of the male terminal to one whose contact position is farther to the distal end of the mating male terminal at the time the two electric components are connected together. In this case, it is preferable that the time-lag application means should further include a plurality of male terminals whose distal ends are all at the same position as seen in the fitting direction of the male terminals to the female terminals and that the plurality of male terminals should all have the same length.

Further scope of applicability of the present invention will become apparent from the detailed description given hereinafter. However, it should be understood that the detailed description and specific example, while indicating preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompany drawings which are given by way of illustration only, and thus, are not limitative of the present invention, and wherein.

DETAILED DESCRIPTION OF THE PREFERRED EMBODIMENTS

The present invention is suitable for specific usage, such as electrically connecting bus bars in an electric connection box for, for example, an automobile to various kinds of electric components, or connecting various connectors of wiring harnesses together. The following will describe preferred embodiments of this invention as adapted to an electric connection box for an automobile.

Figure 1:
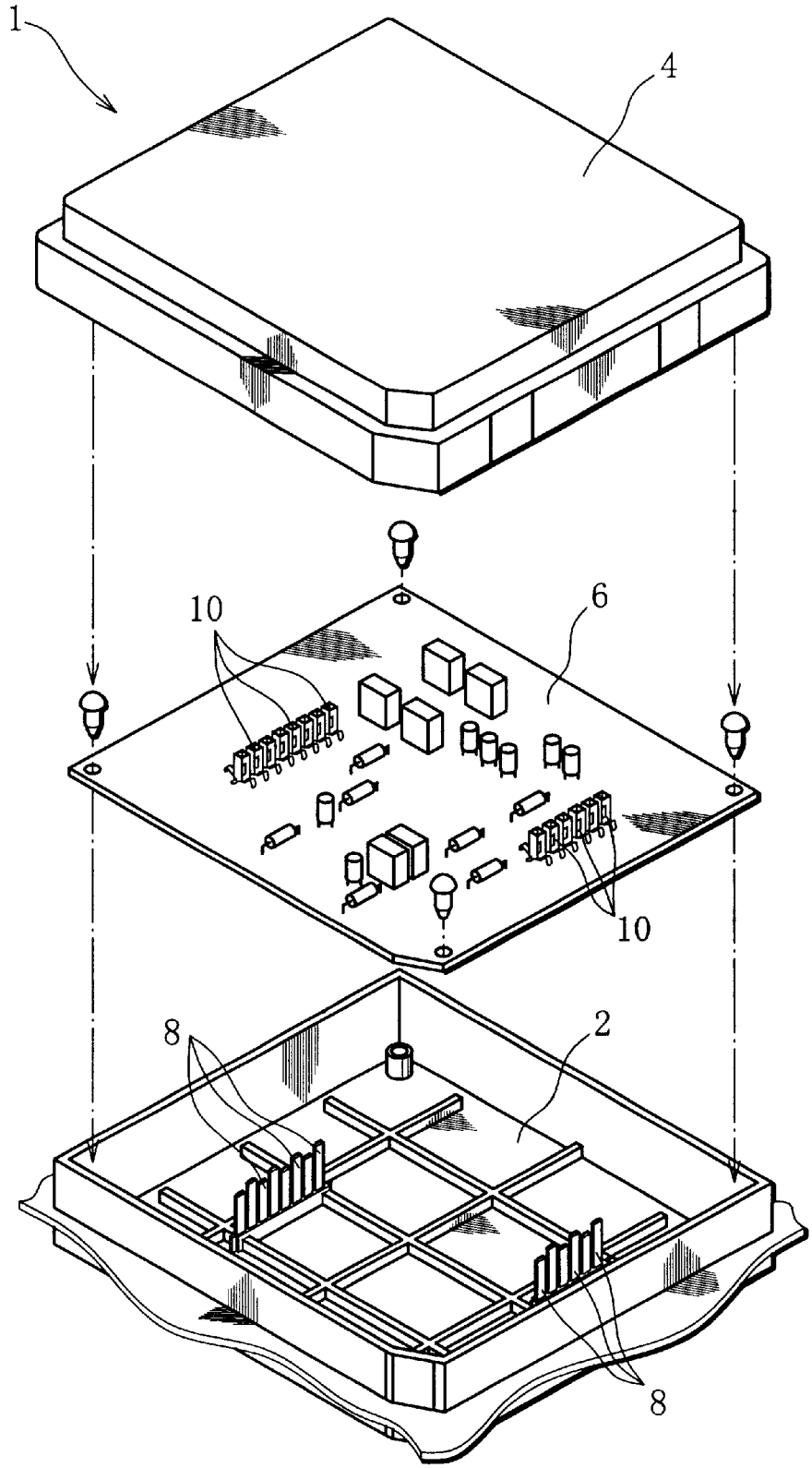
FIG. 1 is an exploded perspective view illustrating an electric connection box embodying this invention.

FIG. 1 illustrates the first embodiment of this invention. As illustrated, an electric connection box has an ECU (Electronic Control Unit) 1 formed therein as a part. The ECU 1 has a lower case 2 and an ECU cover 4, between which an ECU board 6 is placed.

More specifically, the lower case 2 has an open top and retains the ECU board 6 inside, and the ECU cover 4 is placed over the open top of the lower case 2. The ECU board 6, which is designed to be mounted in the lower case 2, is attached to the lower case 2 at four corners by screws.

The bottom of the lower case 2 has a double structure, so that a lamination of unillustrated electric components, such as bus bars and insulating plates, is retained inside the bottom. Protruding upward from the illustrated bottom is a desired array of a plurality of bus bar tabs or male terminals 8 which extend from those bus bars. The array of male terminals 8 is not particularly restrictive, and not only the illustrated one-row pattern but also a pattern of plural rows or an irregular array pattern may be employed. Further, the pitch between the male terminals 8 may be set to the desired value.

Provided on the top surface of the ECU board 6 is an array of female terminals 10 which are to be mated with the male terminals 8. When the ECU board 6 is fitted into the lower case 2 in the fitting direction (downward) indicated by the arrows in the diagram, therefore, the female terminals 10 are fitted over the mating male terminals 8, thus forming electric connection between the bus bars and the ECU board 6.

Figure 2:
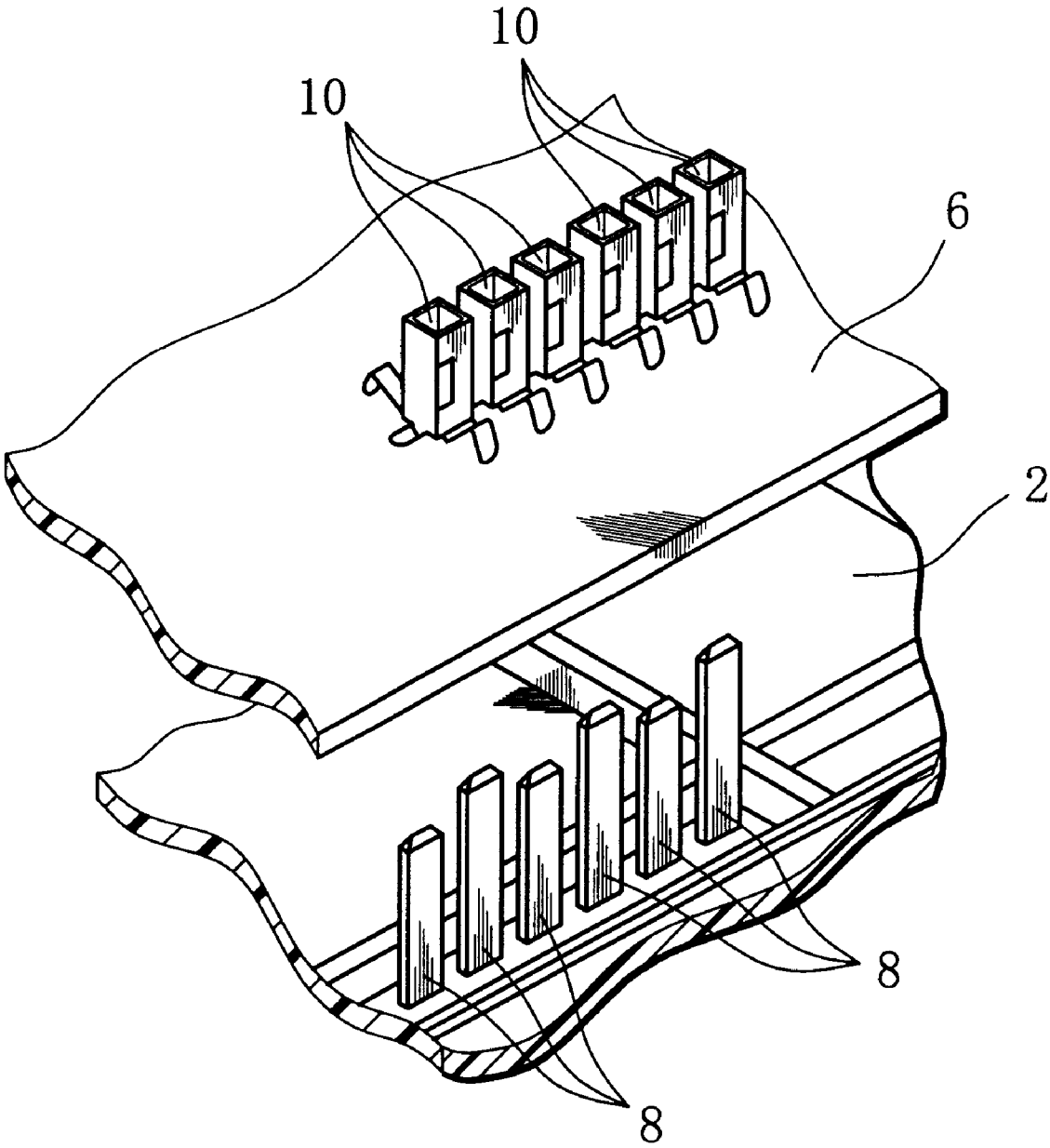
FIG. 2 is a perspective view showing the specific structures of an array of male terminals and an array of female terminals according to a first embodiment of this invention.

As should be more apparent from FIG. 2, not all the individual male terminals 8 have the same protrusion length from the bottom of the lower case 2 in the first embodiment but, for example, alternately have a longer length and a shorter length adjacent to each other.

Figures 3A, 3B, 3C:
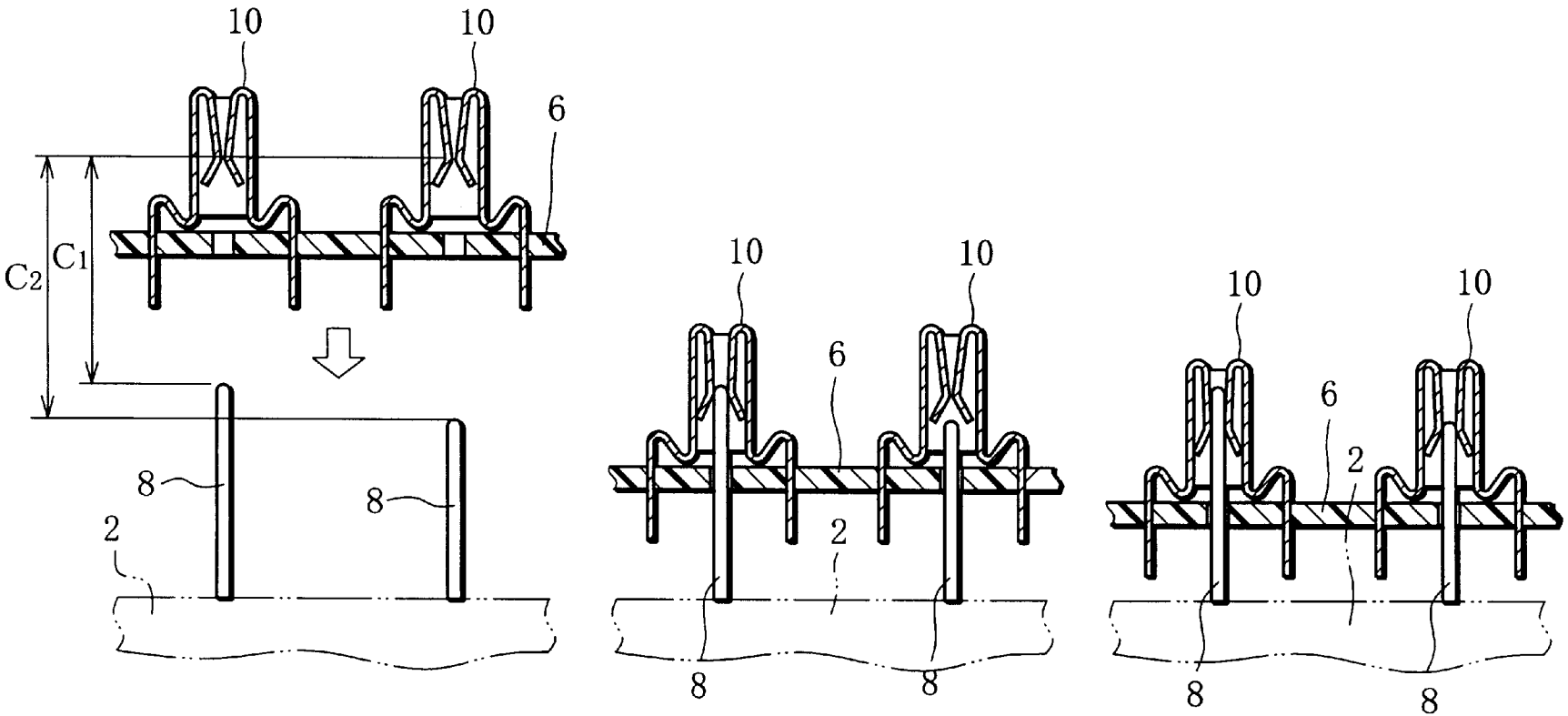
FIGS. 3A through 3C are cross-sectional views showing fitting of the male terminals into the female terminals according to the first embodiment.

The following will give a detailed description of the fitting of the male terminals 8 into the female terminals 10 additionally referring to FIGS. 3A to 3C. For easier understanding of this invention, those FIGS. 3A–3C and FIGS. 4A to 4C and 5A to 5C, which will be referred to later, show the individual male terminals 8 and female terminals 10 in a different array direction from that shown in FIG. 2.

When the ECU board 6 faces the lower case 2 in the proper mounting state as shown in FIG. 3A, the distal ends of the adjoining male terminals 8 are at different positions from each other as seen in the fitting direction to the female terminals 10. Therefore, the distances between the distal ends of the male terminals 8 and the contacts of the female terminals 10 are not the same ($C_1<C_2$). Needless to say, the male terminal 8 that protrudes longer from the bottom of the lower case 2 is longer than the adjacent male terminal 8.

As shown in FIGS. 3B and 3C in sequence, therefore, the longer male terminal 8 has an initial contact with the mating female terminal 10 first as the ECU board 6 is fitted into the lower case 2, then the shorter male terminal 8 has an initial contact with the mating female terminal 10. It should be understood that a time lag is given to the initial contacts between the male terminals 8 and the female terminals 10.

The time lag given to the initial contacts between the male terminals 8 and the female terminals 10 is also set in the second and third embodiments which will be discussed below.

Figures 4A, 4B, 4C:
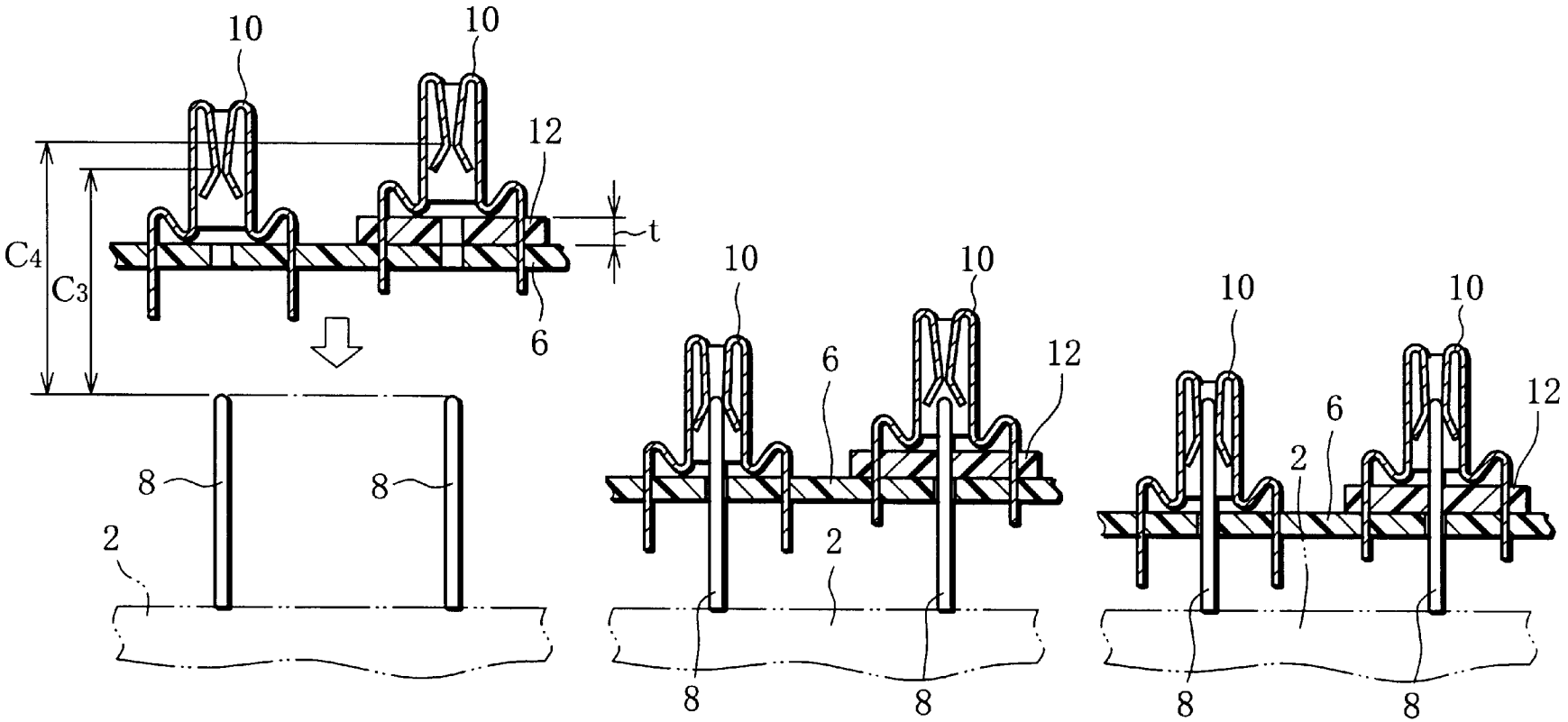
FIGS. 4A through 4C are cross-sectional views showing fitting of male terminals into female terminals according to a second embodiment of this invention.

FIGS. 4A–4C illustrate the second embodiment of this invention. In this embodiment, all the male terminals 8 have the same protrusion length from the bottom of the lower case 2, whereas some of the female terminals 10 have spacers 12 intervened at the proximal ends and the other ones do not. As illustrated, the female terminal 10 with the spacer 12 is offset upward through the spacer 12.

In this case, while all the male terminals 8 have the same length, the distances between the distal ends of the male terminals 8 and the contacts of the mating female terminals 10 are not the same ($C_3<C_4$), as shown in FIG. 4A.

In the second embodiment, as shown in FIGS. 4B and 4C in sequence, the female terminal 10 that is not offset has an initial contact with the mating male terminal 8 first as the ECU board 6 is fitted into the lower case 2, then the female terminal 10 that is offset has an initial contact with the mating male terminal 8. The thicknesses, t, of the spacers 12 may be set the same or may be set different from one another. When the spacers 12 have different thicknesses t, the female terminals 10 that are offset have initial contacts with the mating male terminals 8 in an order of a thinner spacer 12 to a thicker one.

Figure 5A:
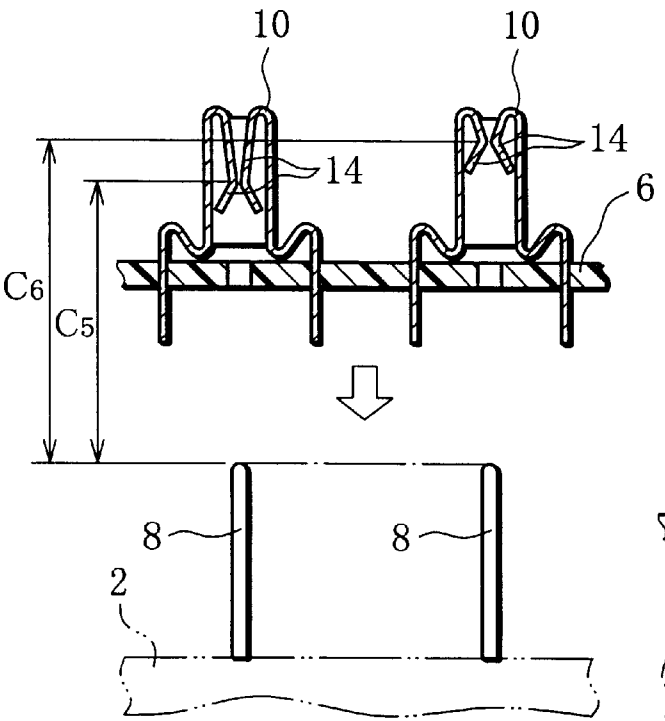
FIGS. 5A through 5C are cross-sectional views showing fitting of male terminals into female terminals according to a third embodiment of this invention.
Figure 5B:
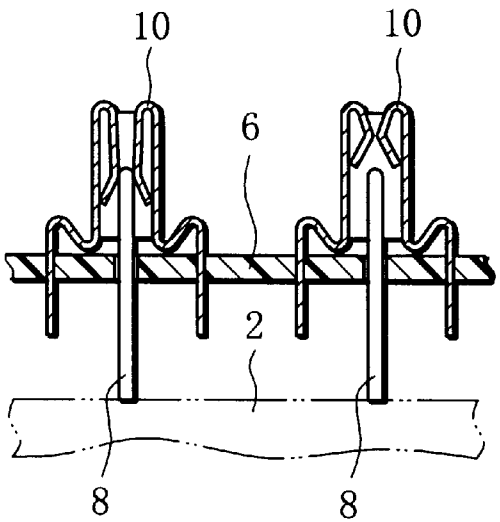
Figure 5C:
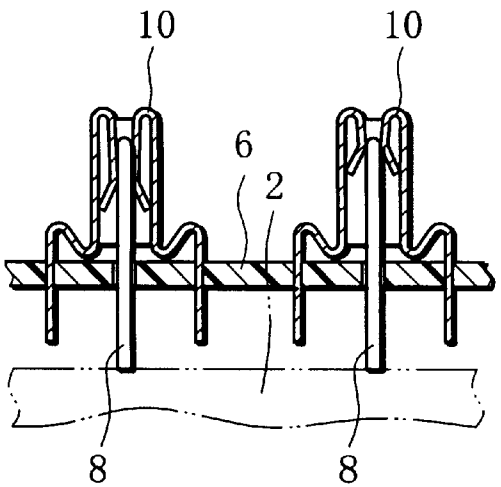

FIGS. 5A–5C illustrate the third embodiment of this invention. As apparent from FIG. 5A, adjoining female terminals 10 have different contact positions to the mating male terminals 8 with respect to the top surface of the ECU board 6 or the positions of their proximal ends as seen in the fitting direction. In the third embodiment, as in the second embodiment, all the male terminals 8 have the same protrusion length from the bottom of the lower case 2.

In the third embodiment, while all the male terminals 8 have the same length, the distances between the distal ends of the male terminals 8 and the contacts of the mating female terminals 10 are not the same ($C_5<C_6$), as per the second embodiment. Specifically, each female terminal 10 has a pair of holding springs 14 which hold the mating male terminal 8 from both sides thereof but the lengths of the holding spring pairs 14 of adjoining female terminals 10 differ from each other.

In the third embodiment, as shown in FIGS. 5B and 5C in sequence, the female terminals 10 have initial contacts with the mating male terminals 8 in an order of a shorter distance between the contact to the distal end of the mating male terminal 8 to a longer distance.

Figure 6:
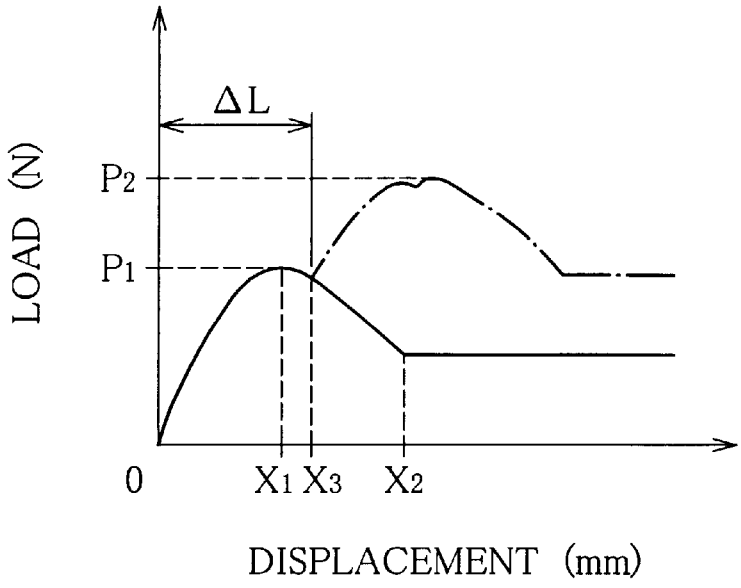
FIG. 6 is a line graph of a displacement vs. load which shows the characteristic of inserting force needed at the time of fitting an ECU board into an electric connection box.
Figure 7:
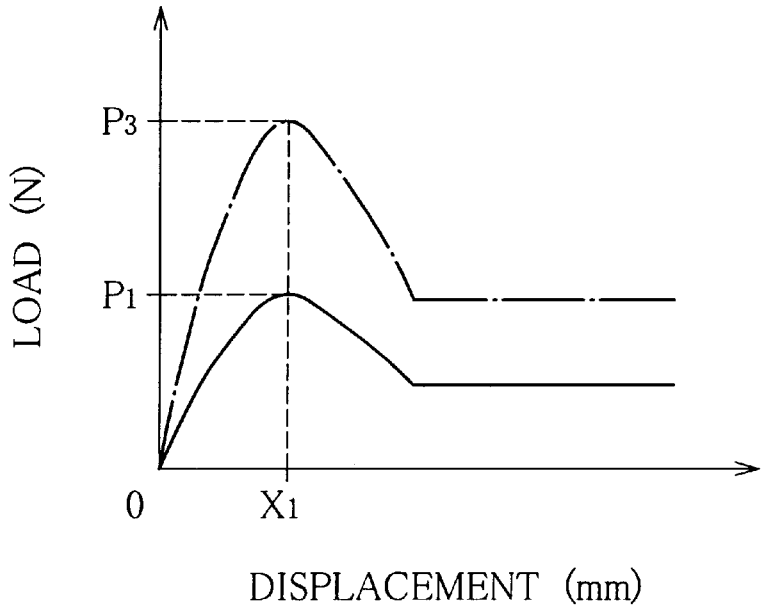
FIG. 7 (PRIOR ART)
FIG. 7 is a line graph of a displacement vs. load according to prior art, which shows the characteristic of needed inserting force to be compared with the inserting force characteristic shown in FIG. 6.

Now, referring to FIG. 6, it shows the characteristic of inserting force of the male terminal 8 needed at the time of fitting the ECU board 6 into the electric connection box in the above-described first to third embodiments in a line graph of a displacement vs. load. FIG. 7 likewise shows the characteristic of needed inserting force according to the prior art. The advantage of this invention over the prior art will become apparent from the comparison of the inserting force characteristic in FIG. 6 with that in FIG. 7.

Specifically, in each embodiment, as the ECU board 6 is pressed into the electric connection box from the first initial contact between the male terminal 8 and the female terminal 10 taken as the origin (displacement=0, load=0), the load or the required inserting force increases in accordance with an increase in the displacement as indicated by the solid line in FIG. 6. At this time, the inserting force of the male terminal 8 increases until the pair of holding springs 14 of the mating female terminal 10 are completely pushed open (displacement=$x_1$) and the inserting force reaches a peak (load=$P_1$) at this point. Thereafter, the inserting force of the male terminal 8 per pole falls as the displacement increases, and the required inserting force becomes approximately constant when the male terminal 8 is completely fit into the female terminal 10 (displacement $>x_2$) and even after the displacement increases.

Paying attention to the amount of displacement ΔL of the ECU board 6 shown by the inserting force characteristic in FIG. 6, when the amount of fitting of the ECU board 6 increases by the amount of displacement ΔL (displacement=$X_3$) from the aforementioned origin (displacement=0), the male terminal 8 has the second initial contact with the female terminal 10 at this point. Therefore, the inserting force that is needed for the entire arrays of male terminals 8 and female terminals 10 increases thereafter in accordance with an increase in the amount of fitting of the ECU board 6 as indicated by the one-dot chain line in FIG. 6 and approximately becomes maximum (load=$P_2$) when the inserting force of the male terminal 8 that has the second initial contact with the mating female terminal 10 reaches a peak. It is preferable that the amount of displacement ΔL should be set to about 0.6 mm in each embodiment.

The following will give further consideration to the inserting force characteristic in FIG. 6 in comparison with that in FIG. 7. According to the prior art, all the male terminals have initial contacts with the mating female terminals at the same time (at the time of displacement=0), and thereafter the inserting forces of the individual male terminals reach peaks at the same time (at the time of displacement=$x_1$). According to the prior art, therefore, the inserting force that is needed for the entire array of male terminals becomes maximum (load=$P_3$) at one time and this inserting force is the maximum value $P_1$ per pole multiplied by the total number of poles ($P_3=P_1\times2$).

According to this invention, by contrast, the inserting forces of the individual male terminals 8 sequentially reach peaks based on the time lags given to the initial contacts with the female terminals 10, so that no excessive inserting force is needed at one time ($P_2<P_3$). This can significantly reduce the working burden on the worker fitting the ECU board 6 into the electric connection box and can greatly improve the workability in each of the embodiments. This invention does not require that the worker should apply unreasonably large force in attaching the ECU board 6 to the lower case 2 and prevents the terminals from being broken in the attaching process.

This invention is in no way restrictive to the above-described embodiments but may be embodied in various modifications. For instance, the combination of the male terminals 8 and the female terminals 10 can be adapted to connection of other electric components in the electric connection box (relay, fuse, connector, capacitor, diode, etc.).

Although the adjoining male terminals 8 are simply classified into a longer one and a shorter one in the first embodiment, the lengths of the male terminals 8 may be made different in several levels.

The thicknesses t and the number of the spacers 12 can be changed as needed in the second embodiment, and the positions of the contacts of the female terminals 10 can be shifted upward or downward within the allowable range in the third embodiment.

Although the inserting force characteristic in FIG. 6 only shows data about adjoining two male terminals 8 and female terminals 10, it should be obvious that for a case of three or more male terminals 8 and female terminals 10 another inserting force characteristic according to the number of the terminals is shown.

The specific structures of the male terminals 8 and female terminals 10 in the above-described embodiments are to be considered as illustrative examples and not restrictive, and the male terminals 8 and female terminals 10 can be designed to have shapes and structures suitable for each of various kinds of electric components.

The present invention is not limited to an electric connection box but can be adapted to connector terminals of a wiring harness. In addition, this invention has a broad general-purposeability as an electric connecting apparatus.

What is claimed is:

1. An electric connecting apparatus for electrically connecting two electric components together, comprising:

an array of male terminals provided on one of said electric components, wherein the array comprises at least four terminals arranged in a row and at least two terminals having a first height are arranged alternatively to the other two terminals having a second height, the second height being different than the firs height;

an array of female terminals provided on the other electric component, each of said female terminals having a pair of holding springs that are pushed apart by a corresponding one of said male terminals inserted therebetween when said two electric components are connected together, said each pair of holding springs holding the corresponding male terminal therebetween with an elastic force, thereby providing electric contact with the corresponding male terminal; and time-lag application means for producing a time lag such that inserting forces with which said male terminals are fitted into said female terminals to push apart the respective pairs of holding springs reach peaks at different times when said two electric components are connected together, said time-lag application means including said male terminals having distal ends located at different positions as viewed in a fitting direction in which said male terminals are fitted into said female terminals.

2. The electric connecting apparatus according to claim 1, wherein said time-lag application means further includes a plurality of female terminals having contacts to said male terminals at same positions as seen in said fitting direction of said male terminals.

3. The electric connecting apparatus according to claim 1, wherein said plurality of male terminals are classified into a type having relatively long lengths and a type having relatively short lengths.

4. The electric connecting apparatus according to claim 3, wherein said time-lag application means further includes a plurality of female terminals having contacts to said male terminals at same positions as seen in said fitting direction of said male terminals.

5. The electric connecting apparatus according to claim 1, wherein said time-lag application means further includes a plurality of female terminals having contacts to said male terminals at same positions as seen in said fitting direction of said male terminals.

6. A method of reducing the insertion force required to insert a plurality of male terminals into a plurality of female terminals comprising:

positioning a contact portion of a first subset of said plurality of female terminals at a first location relative to said male terminals, wherein said male terminals have distal ends located at different positions as viewed in a fitting direction in which said male terminals are fitted into said female terminals, an array of male terminals provided on one of said electric components, wherein the array comprises at least four terminals arranged in a row and at least two terminals having a first height are arranged alternatively to the other two terminals having a second height, the second height being different than the first height; and positioning a contact portion of a second subset of said plurality of female terminals at a second location relative to said male terminals;

whereby different ones of said male terminals make frictional contact with their corresponding female terminals at different moments during the insertion process.

7. The method of claim 6, wherein positioning of some of said female terminals comprises placing said some of said female terminals on spacers.

8. An electric connecting apparatus for electrically connecting two electric components together, comprising:

an array of male terminals provided on one of said electric components;

an array of female terminals provided on the other electric component, each of said female terminals having a pair of holding springs that are pushed apart by a corresponding one of said male terminals inserted therebetween when said two electric components are connected together, said each pair of holding springs holding the corresponding male terminal therebetween with an elastic force, thereby providing electric contact with the corresponding male terminal; and time-lag application means for producing a time lag such that inserting forces with which said male terminals are fitted into said female terminals to push apart the respective pairs of holding springs reach peaks at different times when said two electric components are connected together, said time-lag application means including a spacer arranged between a board and at least one female terminal included in said array of female terminals, for giving an offset, with respect to another female terminal, to a proximal end of said at least one female terminal in a fitting direction in which said male terminals are fitted into said female terminals.

9. The electric connecting apparatus according to claim 8, wherein said space gives an offset in a manner such that the proximal end of said at least one female terminal is located more remotely from a distal end of the corresponding male terminal than those of other female terminals.

10. The electric connecting apparatus according to claim 9, wherein said-time lag application means includes said male terminals having distal ends located at an identical position as viewed in the fitting direction.

11. The electric connecting apparatus according to claim 10, where said male terminals have an identical length.

12. The electric connecting apparatus of claim 8, wherein the spacer is a separate component from the board, and wherein the spacer is in direct physical contact with one of the female terminals and the board, and wherein a least a portion of the female connector is in physical contact with the board.

13. The electric connecting apparatus according to claim 8, wherein said time-lag application means further includes a plurality of male terminals whose distal ends are all at a same position as seen in said fitting direction of said male terminals to said female terminals.

14. The electric connecting apparatus according to claim 13, wherein said plurality of male terminals all have a same length.

* * * * *